US005511815A

United States Patent [19]

Karlsen

[11] Patent Number: 5,511,815

[45] Date of Patent: Apr. 30, 1996

[54] ALPINE STYLE SKI

[76] Inventor: Jørgen Karlsen, N-2864, Fall, Norway

[21] Appl. No.: 526,862

[22] Filed: Sep. 12, 1995

Related U.S. Application Data

[63] Continuation of Ser. No. 98,390, filed as PCT/NO92/00020, Feb. 3, 1992, abandoned.

[30] Foreign Application Priority Data

Feb. 7, 1991 [NO] Norway ..... 91 0487

[51] Int. Cl.[6] ..... A63C 5/052

[52] U.S. Cl. ..... 280/609; D21/229

[58] Field of Search ..... 280/608, 609, 280/14.2, 602; D21/229

[56] References Cited

U.S. PATENT DOCUMENTS

| | | | |
|---|---|---|---|
| 4,971,349 | 11/1990 | Diard et al. . | |
| 5,018,760 | 5/1991 | Remondet | 280/14.2 X |
| 5,242,187 | 9/1993 | Diard et al. | 280/609 |
| 5,286,051 | 2/1994 | Scherubl | 280/609 X |

FOREIGN PATENT DOCUMENTS

| | | | |
|---|---|---|---|
| 144066 | 12/1935 | Austria | 280/608 |
| 435061 | 10/1926 | Germany | 280/609 |
| 2924023 | 12/1980 | Germany | 280/14.2 |
| 3600862 | 7/1986 | Germany . | |
| 88426 | 2/1937 | Sweden . | |
| 351882 | 3/1961 | Switzerland | 280/609 |
| 662744 | 10/1987 | Switzerland . | |
| 668000 | 11/1988 | Switzerland . | |
| 8910167 | 11/1989 | WIPO | 280/14.2 |

*Primary Examiner*—Brian L. Johnson

*Attorney, Agent, or Firm*—Merchant, Gould Smith, Edell, Welter & Schmidt

[57] ABSTRACT

On a front section, an Alpine style ski has a greatly increased width, and the lower edges (3*a*') of the sides (3*a*) are gradually raised on this section so that they diverge upwards in relation to each of two imaginary, straight, parallel lines (2) which constitute extensions of the lower edges (3') of the sides (3) of the rest of the main body.

9 Claims, 2 Drawing Sheets

ALPINE STYLE SKI

This is a file wrapper continuation of application Ser. No. 08/098,390, filed as PCT/NO92/00020, Feb. 3, 1992 and now abandoned.

FIELD OF THE INVENTION

The invention concerns an Alpine ski with upturned tip and a main section with curved sides and approximately flat sliding surface. The term pair ski refers to skis which are intended for use in pairs, i.e. with one ski on each foot, as opposed to so-called monoskis, where both feet are placed on a single ski. The turning technique for pair skis is fundamentally different from that used for monoskis.

BACKGROUND OF THE INVENTION

From CH 668 000 A5 a ski of even width is known, where a front section of the approximately flat sliding surface is bordered at the sides by two bevelled sections. The width of each of the bevelled sections normally increases steadily until they meet at the central axis of the ski at the transition between the main body and the tip. The bordered front section of the two bevelled side sections of the flat sliding surface is thereby normally approximately triangular in shape. Not only does the bevelling increase in width, but the angle of bevelling also increases towards the tip. The object is to reduce resistance during turning.

It is also normal for skis to be slightly wider at the front and the rear, i.e. the sides of the skis are gently curved. This helps to steer the skis through the turns with the least possible loss of kinetic energy. If the sides are curved too much, however, the skis will be difficult to control, since when they are on their edges they will cut into the snow at the front and the rear. Moreover, the grip on the snow in the middle of the ski will be reduced, which is a major disadvantage particularly on a hard cover, where everything depends on being able to skid well in the middle of the ski. For these reasons there is a limit to what can be achieved with this kind of curving of the sides.

CH 662 744 A5 describes a ski whose sides curve substantially inwards. As already mentioned, such skis will be difficult to control.

SUMMARY OF THE INVENTION

The object of the present invention is to provide a ski which makes it possible to turn with the least possible loss of kinetic energy, in that it does not cut too deep into the snow, but still permits the attainment of a good grip when skidding. In this way a faster ski can be obtained which is still easy for the performer to control.

This is achieved in that a front section at most 20 cm in length of the main body has sides whose lower edges diverge so markedly upwards and outwards to the sides in relation to imagined, straight, parallel lines which constitute extensions of the lower edges of the sides of the rest of the main body that (a) at the transition between the main section and the tip, the ski has a width which is 15–70%, preferably 15–50% and best of all 20–30% greater than the width at the transition between the front section and the rest of the main section, and that (b) the lower edge of each side edge here is at a vertical distance above a plane between the said lines which are at least 10%, and preferably at least 15%, e.g. approximately 20% of the increase in width.

In contrast to what is the case of CH 668 000 A5, the skis are thus considerably wider at the front end than at the middle without being difficult to control, the lower edge of each side diverging upwards and thereby being raised sufficiently from the snow to prevent it from cutting into the snow when the skis are on their edges despite the increased ski width at the front end. Thus the upward divergence of the lower edge is closely connected with the pronounced outward curve (the increased width) at the front of the ski. The ski can also be wider at the rear end and the lower edges of the sides can be raised correspondingly. When the skis are slanted or on their edges for turning, the outward curve at the front (and possibly also at the rear) will come into contact with the snow, but the lower edge will not cut into the snow to an undesirable extent. On the contrary, the outward curve will help the performer to make the turn with less skidding and thus a loses less kinetic energy. Unless the skis are edged particularly severely, the outward curve at the front and possibly the rear will not prevent the steel edges on the central section from gripping the snow. With the correct adjustment of angle and curve the skis will still be under full control, even if hard skidding is required.

The absolute width increase in millimeters is naturally dependent on the length of the front section. When this is short, the width increase will have to be in the lower part of the specified area. An interesting design is one in which the length of the front section and the width increase are in the lower range, i.e. the front section is approximately 5 cm long, while the width increase is approximately 15%.

An upward divergence of the lower edge can be achieved by bending the sliding surface on the front section slightly upwards in relation to the sliding surface on the rest of the main body. Another way of achieving upward divergence of the lower edge is to arrange for the sliding surface on the front section to be bordered at the sides by two bevelled sections. These two solutions can naturally be combined in order to achieve the necessary raising of the lower edge. When bevelled side sections are used, these should mainly lie outside the said parallel lines. However, it is also possible to arrange for the width of the sliding surface on the front section to decrease towards the front in a similar way to that described in CH 668 000 A5, which, however, does not have the greatly increased width of the ski in the front section which is an essential condition for the ski according to the invention.

BRIEF DESCRIPTION OF THE DRAWINGS

The invention will be described in more detail with reference to the drawings, which illustrate two preferred embodiments and some variations.

DETAILED DESCRIPTION OF THE DRAWINGS

Figure 1:
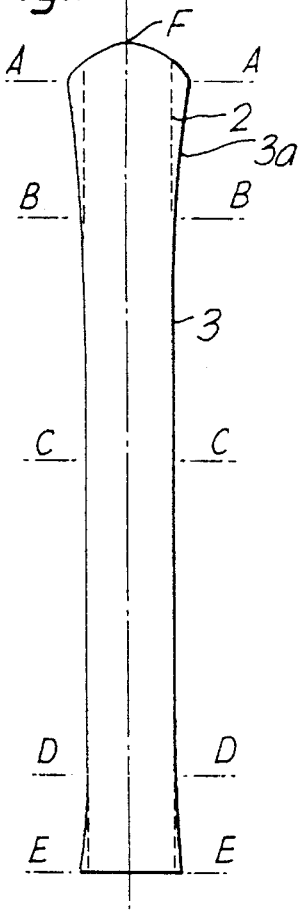
FIG. 1 is an embodiment viewed from above.

In FIG. 1 line C—C indicates the narrowest part of the ski. Between line B—B and the rear end of the ski E—E, the ski has sides 3 with a normal inward curve (outward curve). The lower edge of each side 3 is indicated by 3'.

The ski has a mainly flat sliding surface 1 which on the front section of the ski's main body is indicated by 1*a*. This front section extends from B—B to line A—A, where the underside of the ski begins to curve upwards to form the tip, which ends at point F. The front section should have a length of at most 20 cm, preferably approximately 10–15 cm, but the length can also be less. The section of each side 3 relating to the front section of the ski is indicated by 3*a*, and the corresponding lower edges are indicated by 3*a*'.

Figure 2:
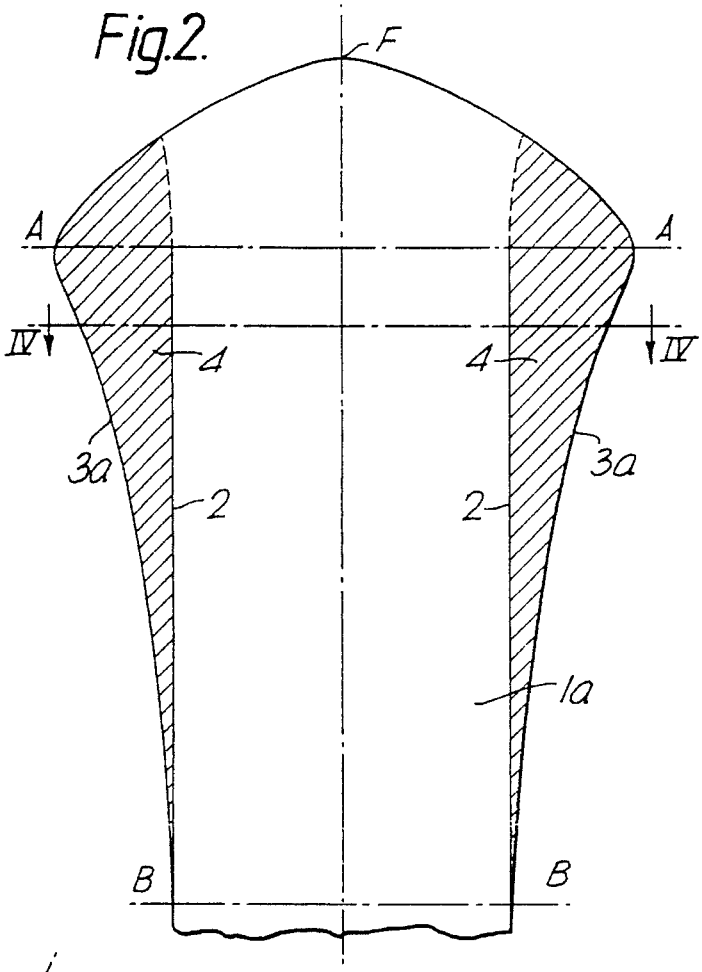
FIG. 2 illustrates the front section of the ski in FIG. 1, viewed from below.
Figure 3:
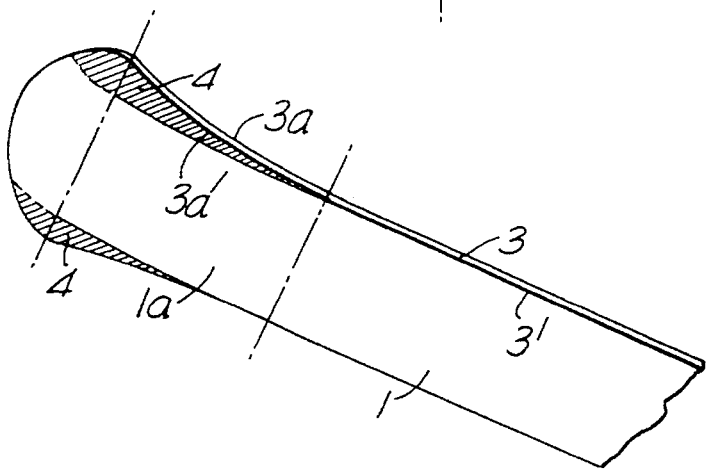
FIG. 3 is a perspective view of the front end of the ski.
Figure 4A:
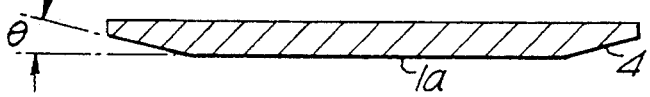
FIGS. 4*a*, 4*b* and 4*c* are three different embodiments of the ski in FIG. 2 in cross section taken along the line IV—IV.
Figure 4B:
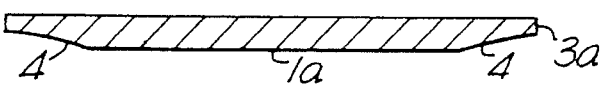
Figure 4C:
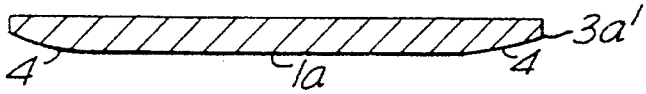
Figure 5:
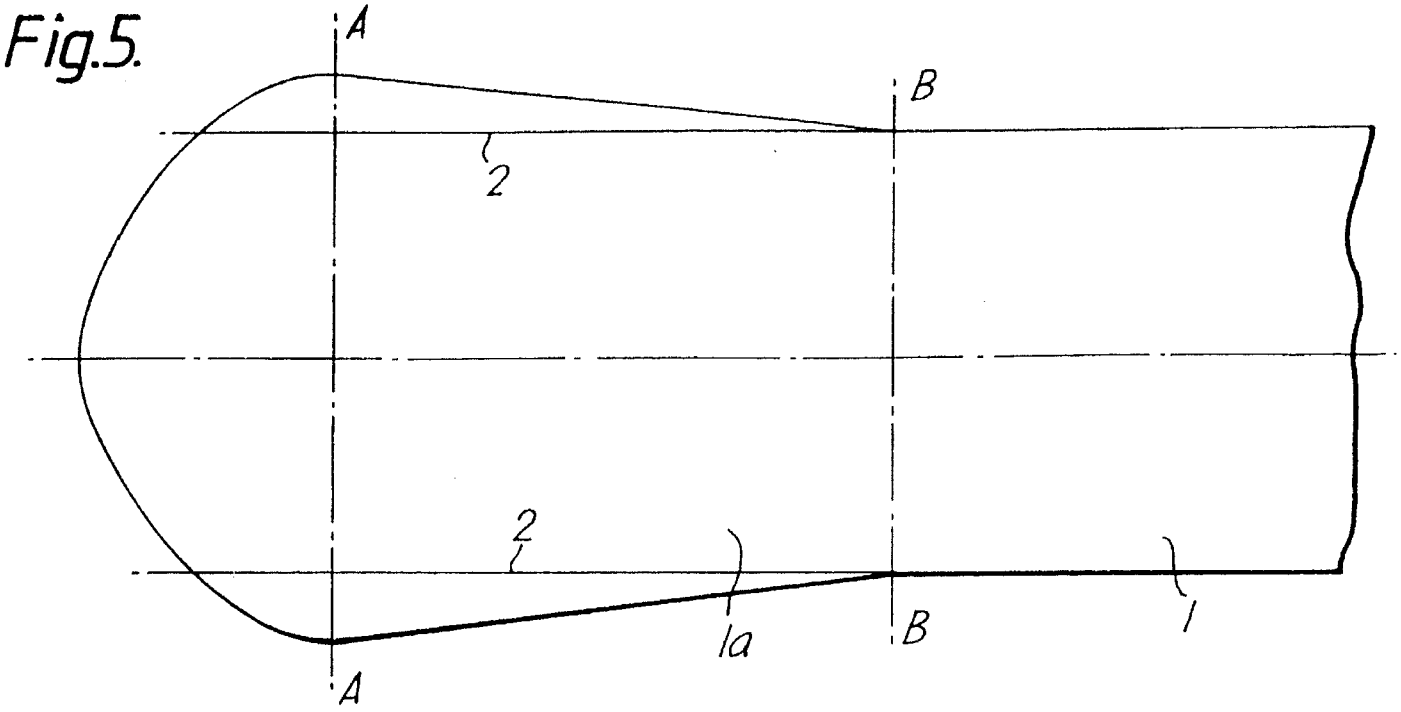
FIG. 5 is another embodiment viewed from below.

In FIGS. 2 and 5 two imaginary parallel lines 2 are drawn constituting extensions of the lower edges 3' of the sides 3 of the main body based on the width of the ski at point B—B. The surfaces 4 between each of these straight lines 2 and the related sides 3*a*' of the ski from point B—B to point A—A are hatched in FIGS. 2 and 3, in order to indicate that these surfaces are bevelled or "slanting" in relation to the ski's sliding surface 1*a*. The bevelling or slanting is best illustrated by FIG. 4.

In FIG. 4*a* the bevelled surfaces 4 are shown as flat, while those in FIGS. 4*b* and 4*c* are shown as a concave and convex curve respectively. It may be suitable for the bevelling angle θ to be constant, but it is within the scope of the invention to allow it to vary between points B—B and A—A. In FIGS. 4*a*–4*c* the upper side of the ski is shown flat, but if the width of the bevelling 4 and the size of the angle θ would otherwise cause the ski to become too thin at the sides 3, it is also possible to curve the upper side upwards at the sides on those sections which are bevelled on the underside.

The result of the illustrated bevelling is that the lower edge 3*a*' of the sides 3*a* will diverge upwards in relation to the lines 2. Thereby the edge 3*a*' will not cut so easily into the snow when the ski is on its edge, despite the increased width of the ski between points B—B and A—A. The bevelling 4 can extend further in towards the middle of the ski than to the lines 2, but the pronounced outward curve of the ski between points B—B and A—A will make it unnecessary to let the bevelling extend so far inwards, and the embodiment illustrated in FIGS. 1–4 is the preferred one.

Figure 6:
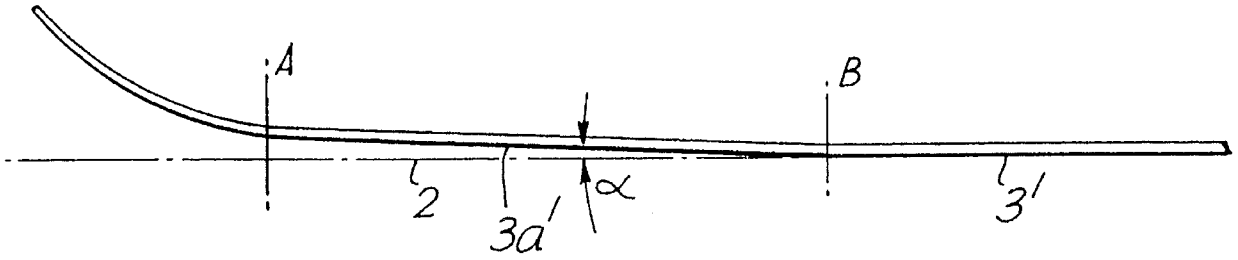
FIG. 6 is a side view of the ski in the embodiment in FIG. 5.

In the embodiment in FIGS. 5 and 6 an upward divergence of the lower edge 3*a*' from the related line 2 is achieved by bending the sliding surface 1*a* on the front section gently upwards in relation to the sliding surface 1 on the rest of the main body. Thereby no bevelling is required in order to prevent the lower edge 3*a*' from cutting into the snow when the skis are on their edges during turning. The angle α between the surfaces 1 and 1*a* can be maintained at a few degrees.

It is, of course, possible to combine the two embodiments. Thus the angle between the sliding surface 1*a* and the front section and the sliding surface 1 can be too small to allow the lower edges 3*a*' to be raised sufficiently. Bevelling can provide the rest of the required upward divergence of each lower edge from the related line 2.

If desired the rear section of the ski (between line D—D and the rear end E—E) can be of a similar design as the front section (between lines A—A and B—B). The rear section can be less extreme with regard to outward curve and upward curve than the front section.

A normal width for an alpine ski at the front end (the root of the tip A—A in the drawing) is 75–90 mm, and the width 5–20 cm behind the front end (corresponding to line B—B) is a few millimeters less. In the case of the ski according to the invention on the other hand, the width will increase substantially more towards the front, preferably by 15–20 mm, but an increase of as little as 12 mm or as much as 60 mm is also conceivable. An appropriate raising of the lower edges 3*a* in relation to the lines 2 will be from 2–10 mm, but higher values are conceivable.

What is claimed is:

1. A ski comprising:

a main body having a top side and a bottom side, the main body including a body segment and an upwardly bent segment, the bottom side of the body segment including a substantially flat sliding surface defining a plane;

an upturned tip, the tip meeting the upwardly bent segment of the main body at a first transition;

a second transition along the main body;

the main body and the tip including oppositely disposed first and second sides, each of the first and second sides including oppositely disposed upper and lower edges, the upper and lower edges extending substantially along the length of the ski;

a longitudinal axis extending along the length of the main body and the tip;

the first and second sides along the main body being curved;

the first and second sides of the tip including outwardly extending portions, and the first and second sides of the main body including outwardly extending portions, the outwardly extending portions on the main body extend along at least part of the upwardly bent segment, the outwardly extending portions on the main body tapering outward from the second transition to the first transition, such that the outwardly extending portions of the main body join the outwardly extending portions of the tip at the first transition;

the first transition having a width approximately 15% to 70% greater than the width of the second transition;

the outwardly extending portions of the tip and the outwardly extending portions of the main body forming side sections, each of the side sections including an upper surface and a lower surface, the upper surface extending to the upper edges of the respective first and second sides, the lower surface diverging upwards and extending to the lower edges of the respective first and second sides, and outwards in relation to the longitudinal axis of the ski, the vertical distance between the lower edges of the first and second sides at the first transition and the plane of the sliding surface being at least 10% of the increase in width between the first transition and the second transition.

2. The ski according to claim 1, wherein the main body includes a front section and a rear section, the front section extending from the first transition to the second transition, the front section extending less than 20 cm.

3. The ski according to claim 2, wherein the front section is approximately 5 cm long, the front section increasing approximately 15% in width from the first transition to the second transition.

4. The ski according to claim 3, wherein the front section of the main body includes the upwardly bent segment and the rear section includes the body segment.

5. The ski according to claim 1, wherein the width of the first transition is approximately 15% to 50% greater than the width at the second transition.

6. The ski according to claim 5, wherein the width of the first transition is approximately 20% to 30% greater than the width at the second transition.

7. The ski according to claim 1, wherein the vertical distance between the lower edges of the respective first and second sides at the first transition and the plane of the sliding surface is approximately 20% greater than the increase in width between the first transition and the second transition.

8. The ski of claim 1, wherein the outwardly extending portions of the first and second sides of the tip and the first and second sides of the main body are curved.

9. The ski of claim 1, wherein the body segment meets the upwardly bent segment at the second transition.

* * * * *